US006880994B2

(12) United States Patent
Takahashi

(10) Patent No.: US 6,880,994 B2
(45) Date of Patent: Apr. 19, 2005

(54) KEYBOARD AND ELECTRONIC APPARATUS HAVING THE SAME

(75) Inventor: Kouki Takahashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/629,738

(22) Filed: Jul. 30, 2003

(65) Prior Publication Data

US 2004/0033097 A1 Feb. 19, 2004

(30) Foreign Application Priority Data

Aug. 16, 2002 (JP) ..... 2002-237525

(51) Int. Cl.[7] ..... B41J 5/28

(52) U.S. Cl. ..... 400/472; 400/490; 400/495; 400/491

(58) Field of Search ..... 400/472, 490, 400/495, 491, 495.1; 361/679; 200/344, 345

(56) References Cited

U.S. PATENT DOCUMENTS

| | | | | | |
|---|---|---|---|---|---|
| 5,278,372 | A | * | 1/1994 | Takagi et al. | 200/344 |
| 5,813,521 | A | * | 9/1998 | Koike et al. | 200/344 |
| 6,100,482 | A | * | 8/2000 | Koma et al. | 200/344 |
| 6,257,782 | B1 | * | 7/2001 | Maruyama et al. | 400/495.1 |
| 6,371,671 | B1 | * | 4/2002 | Sato et al. | 400/495 |
| 6,608,416 | B1 | * | 8/2003 | Nishimura | 310/90 |
| 6,618,239 | B1 | * | 9/2003 | Takahashi et al. | 361/679 |

FOREIGN PATENT DOCUMENTS

JP 2000-348562 12/2000

* cited by examiner

*Primary Examiner*—Andrew H. Hirshfeld
*Assistant Examiner*—Marissa Ferguson
(74) *Attorney, Agent, or Firm*—Staas & Halsey LLP

(57) ABSTRACT

A keyboard includes a plurality of keys for entering information, a moving mechanism for descending and ascending each key in a direction different from a vertical direction and for maintaining an orientation of the key top, and a forcing member for forcing the moving mechanism to return the key to an original state.

12 Claims, 7 Drawing Sheets

PRIOR ART

KEYBOARD AND ELECTRONIC APPARATUS HAVING THE SAME

BACKGROUND OF THE INVENTION

The present invention relates generally to keyboards, and more particularly a keyboard attached to a laptop personal computer ("PC"), a personal digital assistant ("PDA"), and other portable electronic apparatuses.

Along with the recent development and spread of the laptop PCs, small and low-profile bodies convenient for portability have been increasingly demanded. In addition, laptop PCs with a low-profile body have been demanded to detect keying-in with precision and to provide ergonomically good operability.

For the low-profile laptop PC, a method for thinning a keyboard has been investigated. For example, Japanese Laid-Open Patent Application No. 11-213806 proposes a key moving mechanism, which is also referred to as a pantograph mechanism. Here, FIG. 6 is a schematic partial sectional view of a conventional key moving mechanism. A moving mechanism 510 shown in FIG. 6 includes a linkage that crosses like an X-shape. When a key 502*a* is pressed down, the moving mechanism 510 deforms around a rotary part 512 and slides through slide parts 514. Then, a contact 504*a* in a rubber member 504 contacts switch parts 518 on a base 516, and transmits keying information to a substrate (not shown). FIG. 7 shows a schematic partial sectional view of another conventional keyboard structure disclosed in Japanese Laid-Open Patent Application No. 2001-597651. Here, FIG. 7 is a schematic partial sectional view of another conventional key moving mechanism. The moving mechanism 620 shown in FIG. 7 is a V-shaped linkage referred to as a gear linkage, in which when a key 602*b* is pressed down, a moving mechanism 620 rotatably attached to a rotary part 623 engages with a gear part 624 and slides through slide parts 622. Accordingly, a contact 604*b* in a rubber member 604 contacts a switch part 628 on a membrane 630 and transmits press information to a base (not shown).

The conventional moving mechanisms shown in FIGS. 6 and 7 ascend and descend the key in a vertical direction, and thus are unsuitable for the low-profile body. This is because a user ergonomically feels uncomfortable unless a keystroke as a distance by which the key top travels (KS in FIGS. 6 and 7) is equal to or larger than the predetermined distance, and this predetermined distance hinders the low-profile body.

On the contrary, Japanese Laid-Open Patent Application No. 2000-348562 discloses a moving mechanism for descending and ascending the key in an oblique direction, rather than the vertical direction. The moving mechanism in this reference shortens the vertical length convenient for low-profile body while moving the key in the oblique direction so as to maintain the long keystroke. However, the moving mechanism may disadvantageously incline the key top in moving the key, consequently causing contact failure between the contact and switch part and resultant recognition failure of keying. The inclined, moving key top also makes a user uncomfortable.

BRIEF SUMMARY OF THE INVENTION

Accordingly, it is an exemplary object of the present invention to provide a novel and useful keyboard and an electronic apparatus having the same in which the conventional problems are eliminated.

Another and more specific object of the present invention is to provide a keyboard and an electronic apparatus having the same, which has ergonomically good operability and stably detects keying.

In order to achieve these and other objects, a keyboard of one aspect of the present invention includes a plurality of keys for entering information, a moving mechanism for descending and ascending each key in a direction different from a vertical direction and for maintaining an orientation of the key top, and a forcing member for forcing the moving mechanism to return the key to an original state. Such a keyboard moves the key in a direction different from the vertical direction, such as an oblique direction and a circumferential direction, thereby maintaining a longer keystroke than a keyboard that moves the key in the vertical direction. Therefore, this keyboard may maintain ergonomically comfortable operability for the user. In addition, the moving mechanism maintains the orientation of the key top, preventing the moving key top from inclining and stably detects keying.

The moving mechanism may include first and second members, rotatably provided on a base that is fixed relative to the key, for supporting the key, and a coupling member for connecting the first and second members to each other and for synchronizing movements of the first and second members. This keyboard uses the coupling member to synchronize rotations of the first and second members and prevents the inclination of the key top.

The first and second members may have U-shapes that face each other, and the forcing member may be located between the first and second members and made of an elastic member. This keyboard uses mutually opposing U-shapes to prevent a collision of the first and/or second members with the forcing member while the key is moving.

The first and second members may support the key at four points, and the coupling member may synchronize movements of the four points. This keyboard uses the coupling member to synchronize movements of these four points and prevents the inclination of the key top.

The moving mechanism may include a rotary mechanism that rotates around a base fixed relative to the key, and the keyboard may further comprise a stopper for restricting a rotary angle of the moving mechanism so that the rotary angle of the moving mechanism may fall within a present range. This keyboard uses the stopper to restrict the rotary angle of the moving mechanism, and thereby the moving mechanism may always rotate and enable the key top to approach, for example, to the user.

The forcing member may be a hollow elastic member, and the keyboard may further comprise, in a hollow part in the elastic member, a projection part for transmitting information on keying to a switch part for recognizing the keying. Since the elastic member may deform independent of the moving member, the projection part may move in the vertical direction, for example, and contacts the switch part for recognizing that the key has been pressed down.

An electronic apparatus of another aspect of the present invention includes the above keyboard, and a display part for displaying information input from the keyboard. Such an electronic apparatus may realize a low-profile body and exhibit the above operations associated with the keyboard.

Other objects and further features of the present invention will become readily apparent from the following description of the embodiments with reference to accompanying drawings.

DETAILED DESCRIPTION OF THE INVENTION

Figure 1:
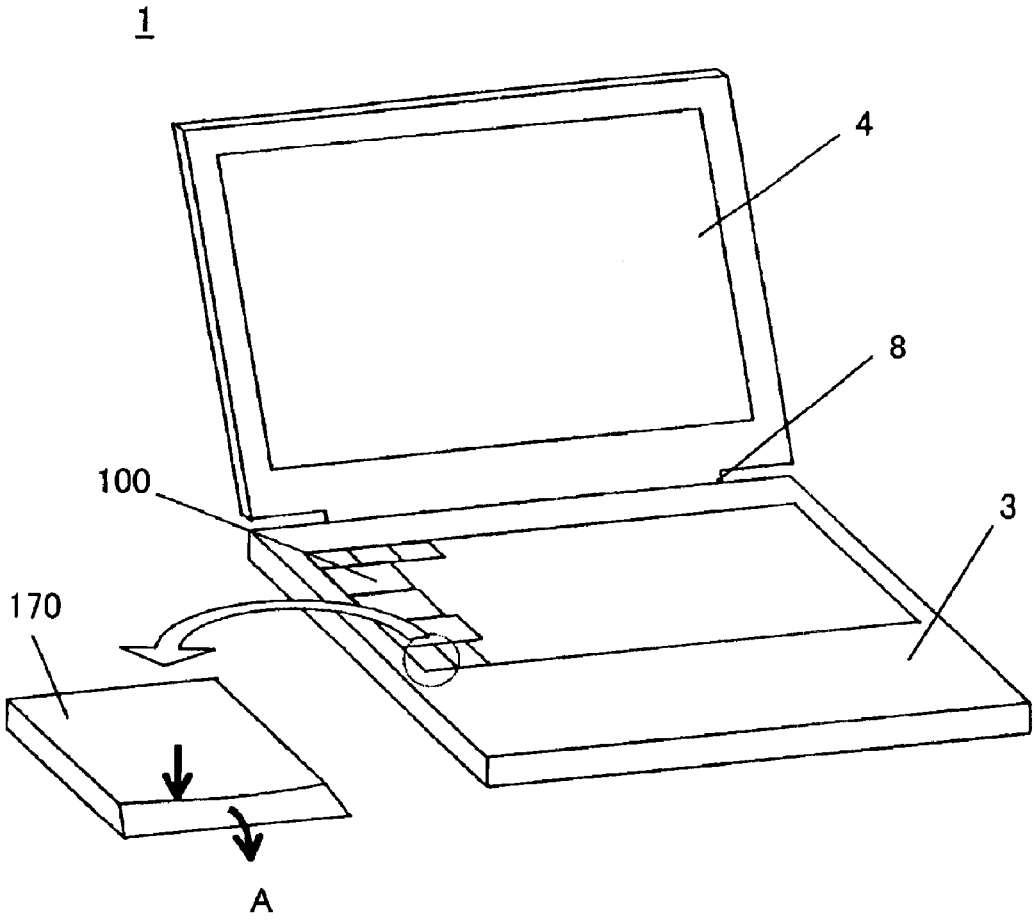
FIG. 1 is a schematic perspective view of a laptop personal computer as an electronic apparatus as one embodiment according to the present invention, and its keyboard.
Figure 2:
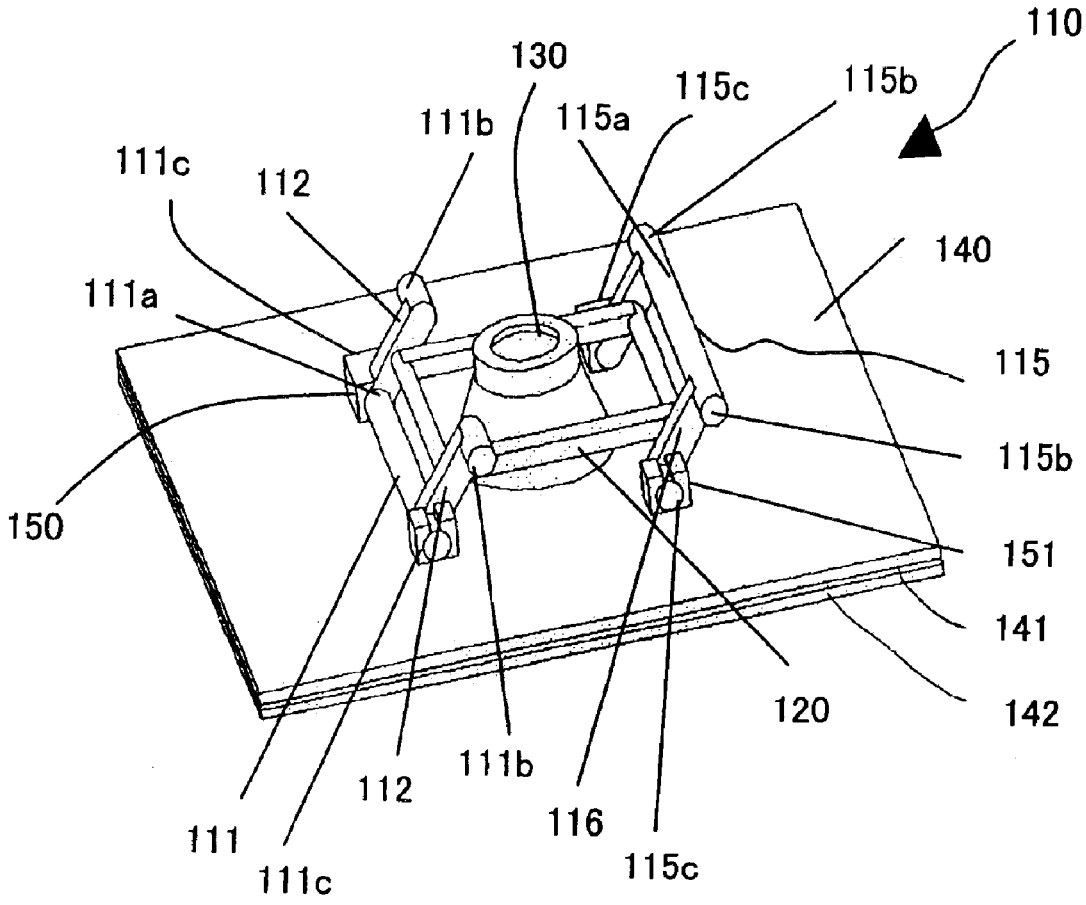
FIG. 2 is a schematic perspective view of a moving mechanism used for the laptop personal computer shown in FIG. 1.
Figure 3:
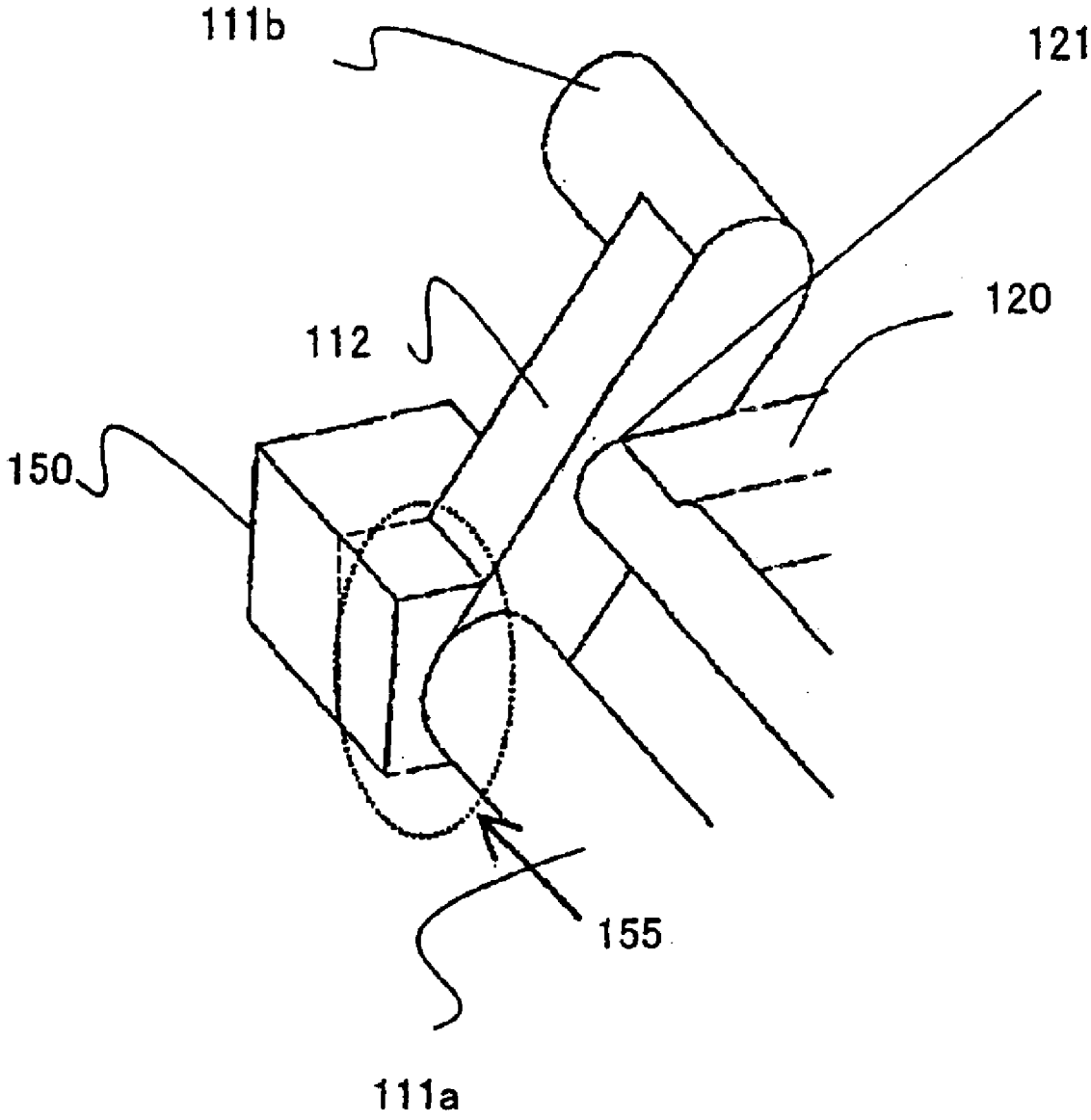
FIG. 3 is a schematic enlarged perspective view of a stopper of the moving mechanism shown in FIG. 2.
Figure 4:
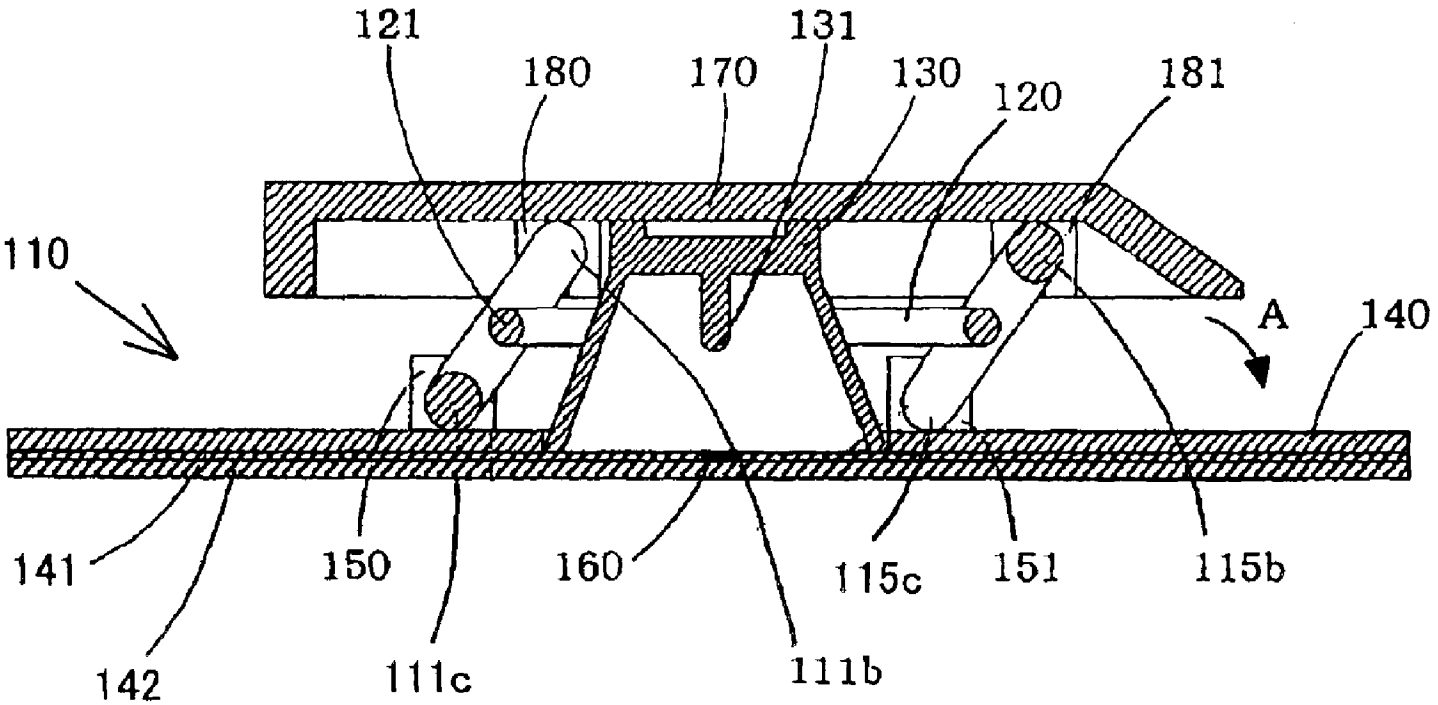
FIG. 4 is a schematic sectional view of an initial state of the moving mechanism shown in FIG. 2.
Figure 5:
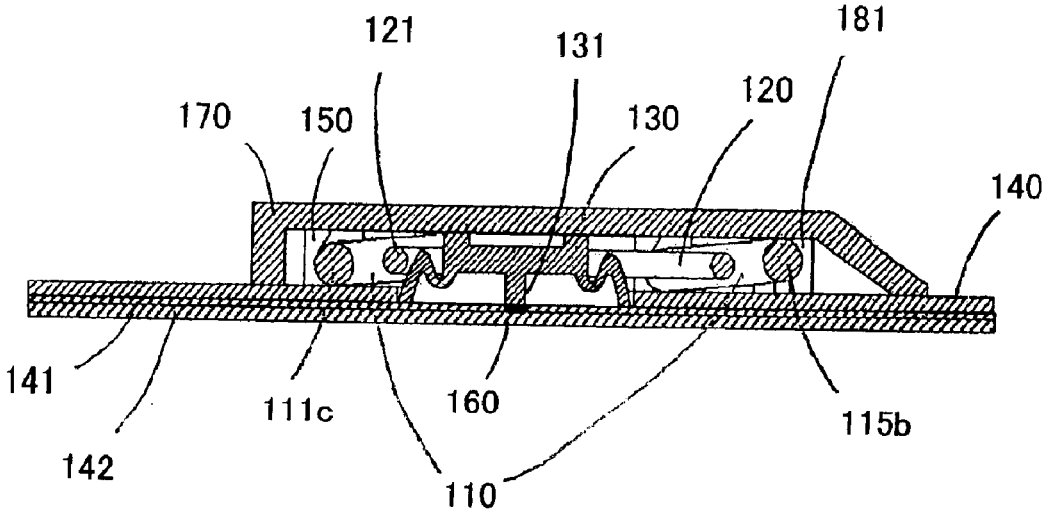
FIG. 5 is a schematic sectional view showing a keying state of the moving mechanism shown in FIG. 4.
Figure 6:
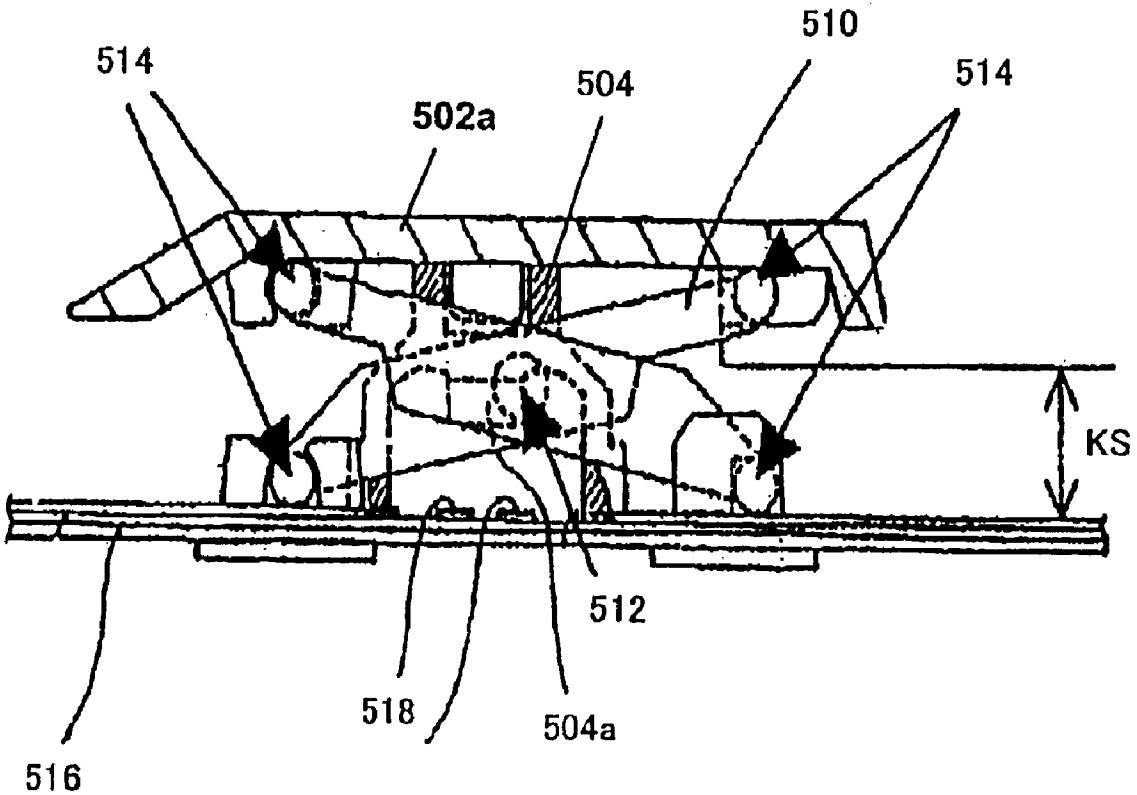
FIG. 6 is a schematic sectional view showing a linkage of a conventional keyboard.
Figure 7:
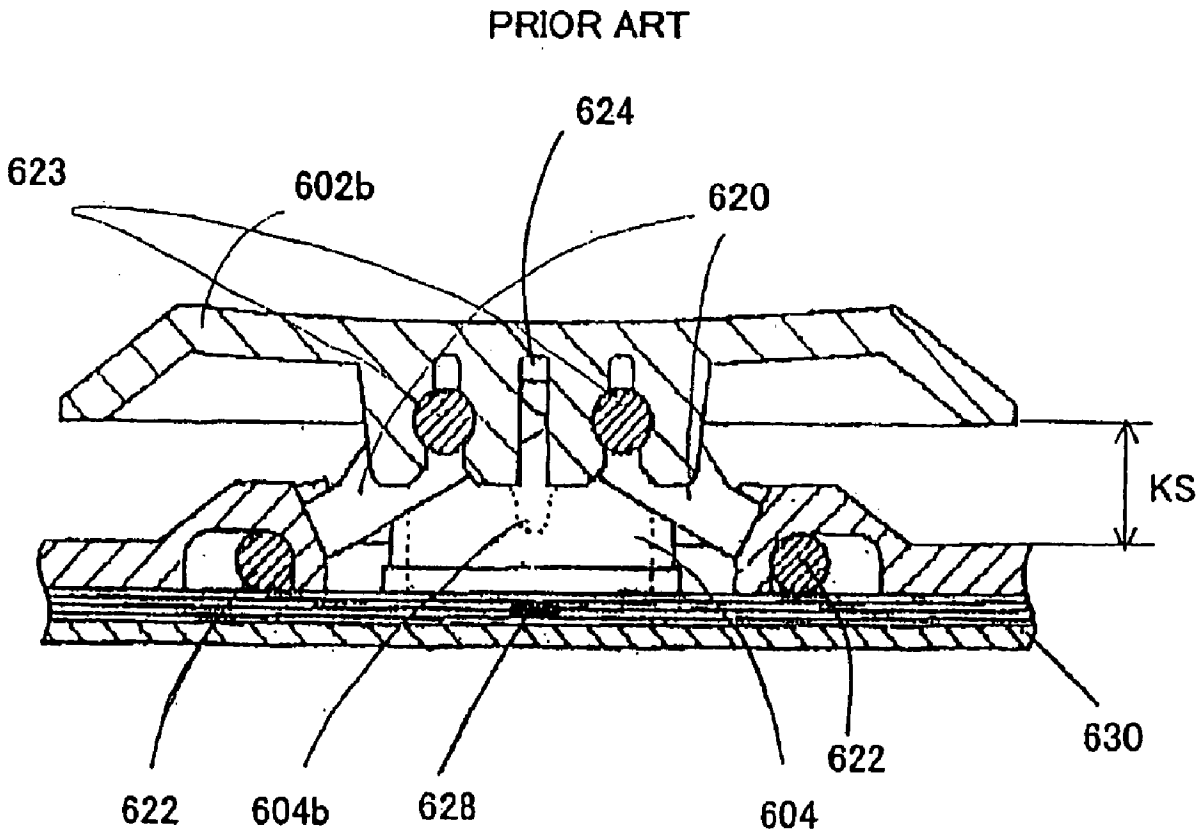
FIG. 7 is a schematic sectional view showing a variation of the linkage of the keyboard shown in FIG. 6.

Referring now to FIGS. 1 to 5, a description will be given of a moving mechanism 110 as one embodiment according to the present invention, and an electronic apparatus 1 having the moving mechanism 110. Here, FIG. 1 is a schematic perspective view of the electronic apparatus 1. FIG. 2 is a schematic perspective view of the moving mechanism 110. FIG. 3 is a schematic enlarged perspective view of a stopper 155 for controlling the height of the moving mechanism 110. FIG. 4 is a schematic sectional view of an initial state of the moving mechanism 110. FIG. 5 is a schematic sectional view showing a keying state of the moving mechanism 110.

Referring to FIG. 1, the electronic apparatus 1 is exemplarily shown as, but not limited to, the laptop PC, and includes PDAs, handheld PCs, palm-size PCs, wearable computers, portable electronic apparatuses, portable terminals, etc. The laptop PC 1 may cover A4, B5, sub-laptop, mini-laptop and other sizes.

The laptop PC 1 includes a liquid crystal display (LCD) bezel frame 2 and a housing 3 which are connected to each other via a hinge 8, and an LCD screen 4 is placed on the LCD bezel frame 2. The LCD bezel frame 2 has a substantially rectangular shape so as to hold the LCD screen 4. The housing 3 includes a keyboard 10 for typing information in. The keyboard may use any type including 101, 106, 109 and ergonomics, and any key arrangement including QWERTY, DVORAK, JIS, new-JIS, and Nihongo Nyuryoku Conthotium Layout ("NICOLA").

The housing 3 also includes a pointing device 6 that emulates part of mouse functions. Despite the structure shown in FIG. 1, the pointing device 6 may include a mouse, a trackball, a trackpad, a tablet, a digitizer, a joystick, a joypad, a touch panel, and a stylus pen.

The housing 3 forms an extension bay slot (not shown) into which plural kinds of extension units are detachably inserted. When the laptop PC 1 is viewed from the left side surface, the extension bay slot has an approximately L-shape including an opening part (not shown). A cover (not shown) is attached to the laptop PC 1, which is engageable with the opening part at the left side, and the cover is removed so as to expose the opening part and enable the extension unit to be inserted. The cover may be provided on the left or any other surface of the laptop PC 1 via a spring and hinge structure.

The keyboard 100 is a device that includes a plurality of keys 170 for entering information. The keyboard 100 includes plural keys 170, a moving mechanism 110, an elastic member 130, a contact 131, a base 140, a membrane 141, a metal plate 142, and switch parts 160. Here, the contact 131 has the same structure as the projection part 131.

The moving mechanism 110 is a mechanism for supporting, descending, and ascending the key 170, and includes, as shown in FIG. 2, a first member 111, a second member 115, a coupling member 120, and a stopper 155. The first and second members 111 and 115, and the coupling member 120 are molded, for example, from an insulating material, such as resin. Alternatively, the first and second members 111 and 115 may be formed by bending a metal plate.

The first and second members 111 and 115 have the same U-shape rotatably fixed onto the base 140 in this embodiment, and support the key 170. Two components, i.e., the first and second members 111 and 115, having the same shape would facilitate manufacture in comparison with two members having different shapes. The U-shape in the first and second members 111 and 115 synchronizes its left and right legs, as described later. These U-shapes of the first and second members 111 and 115 are arranged so that their openings face each other, as described later. Preferably, the first and second members 111 and 115 are arranged on a rear surface of the key 170 symmetrically with respect to the center of gravity of the key 170, so as to prevent the key 170 from inclining.

The first and second members 111 and 115 include, as shown in FIGS. 2 and 3, lateral members 111*a* and 115*b*, longitudinal members 112 and 116, and rotary parts 111*b*, 111*c*, 115*b* and 115*c*. The rotary parts 111*b* and 115*b* are rotatably fixed onto engagement parts 180 and 181 provided on the rear surface of the key 170. As shown in FIG. 2, the rotary parts 111*b* and 115*b* are formed at top ends of the longitudinal members 112 and 116, while the rotary parts 111*c* and 115*c* are formed at bottom ends of the longitudinal members 112 and 116. Although the instant embodiment arranges the rotary parts 111*b* and 115*b* perpendicular to the longitudinal members 112 and 116 so that the rotary parts 111*b* and 115*b* project outside the longitudinal members 112 and 116, the rotary parts 111*b* and 115*b* may be arranged perpendicular to the longitudinal members 112 and 116 while projecting between the longitudinal members 112 and 116. The engagement part 150 on the base 140 may be engaged with the lateral member 111*a* instead of the rotary parts 111*c*. Then, the rotary parts 111*c* may be omitted.

When the rotary parts 111*b* project between a pair of longitudinal members 112, the rotary parts 111*b* may possibly contact the coupling member 120 and the elastic member 130 as the key 170 descends and hinders descent of the key 170. The coupling member 120 formed outside the longitudinal members 112 and the smaller elastic member 130 would not contact the rotary parts 111*b* and allow the rotary parts 111*b* to be formed between the longitudinal members 112. The instant embodiment employs the U-shape for the first members 111, but the height of the lateral members 111*a* may be variable as long as the lateral members 111*a* do not contact the coupling member 120 and the elastic member 130. In such a case the first shape 111 has an H-shape.

The first member 111 rotates, descends and ascends the key 170 around the engagement 150 and the lower rotary parts 111*b*. The first member 111 includes two pairs of rotary parts 111*b* and 111*c* at four points. In the instant embodiment, the rotary parts 111*c* project from the longitudinal members 112 and 116, and are engaged with the engagement parts 180 on the key 170 that have a concave dent or connection hole. Alternatively, the rotary parts 111*c* in the first member 111 have a concave dent or connection hole, while the projection part may be formed at the engagement parts 180 on the key 170.

The coupling member 120 is molded by the same molding material as the first and second members 111 and 115, and has an approximately hollow rectangular shape in this embodiment. Such an approximately hollow rectangular shape serves to maintain constant an interval between the first and second members 111 and 115. For example, only a rod-shaped member may maintain the interval between the first and second members 111 and 115, and thus the coupling member 120 may be replaced with only one component to achieve this function. Therefore, the shape of the coupling member 120 in FIG. 2 is exemplary purposes. The coupling member 120 includes two pairs of interlock parts 121, and is attached through the interlock parts 121 to almost centers of the first and second members 111 and 115, as shown in FIG. 2. The coupling member 120 connects the first and second members 111 and 115 to each other to synchronize their rotational movements with each other, and serves to maintain the horizontalness of a top surface of the key 170, i.e., the key top. As a result, an inclination of the key 170 and the resultant detection failure of keying may be prevented. The interlock parts 121 are formed at four ends of the coupling member 120 and connected rotatably to the first and second members 111 and 115. The interlock parts 121 enable the first and second members 111 and 115 to synchronously rotate together. The interlock parts 121 include a projection or dent, whereas the first and second members 111 and 115 include a dent or projection. Alternatively, the interlock part 121 is a screw, while the first and second members 111 and 115 include a screw hole, vice versa.

The second member 115 includes a pair of longitudinal parts 116, the lateral member 115*a*, and a pair of rotary parts 115*b*. In this embodiment, the second member 115 is formed like a U-shape whose opening is arranged opposite to that of the first member 111. The rotary part 115*b* and 115*c* are provided at four ends of the second member 115, as shown in FIG. 2. As shown in FIG. 4, a pair of rotary parts 115*b* are inserted into a pair of base engagement parts 151 while a pair of rotary parts 115*c* are inserted into a pair of key engagement parts 181. Positions of the interlock parts 121 may be variable as long as the coupling member 120 do not collide with the elastic member 130 while the key 170 is pressed. The second member 115 is connected rotatably with the center of the longitudinal member 116 in the first member 111 by the coupling member 120. The connection may use any structure known in the art, such as a screw, and a concave/convex engagement. In comparison with the reference that does not include the coupling member 120, the coupling member 120 may synchronize the first and second members 111 and 115 certainly, preventing the inclination of the key top. The second member 115 works similar to the first member 111. The rotary parts 115*b* and 115*c* are formed at four ends of the second member 115, and made of the same material as the second member 115. It is molded with the second member 115, similar to the rotary parts 111*b* and 111*c* in the first member 111. The rotary part 115*b* and 115*c* serve to rotatably engage the key 170 and the base 140 with the second member 115, and allow the rotation of the key 170 in cooperation with the key engagement part 181 and base engagement part 151. Similar to the first member 111, the instant embodiment provides the rotary part 115*b* and 115*c* with a projection part and the key and base engagement parts 151 and 181 with a dent or connection hole. Alternatively, the key and base engagement parts 151 and 181 may be provided with a projection whereas the rotary parts 115*b* and 181 may be provided with a dent or connection hole.

The engagement parts include base engagement parts 150 and 151 formed on the base 140, and key engagement parts 180 and 181 formed on the rear surface of the key 170. The engagement parts include a connection hole or dent for rotatably supporting the moving mechanism 110. In another embodiment, the engagement part includes a convex, while the moving mechanism 110 has a connection hole or dent engageable rotatably with the convex. The engagement part 150 includes a stopper 155 for restricting an ascent of the moving mechanism 110, as shown in FIG. 3, which is a schematically enlarged perspective view of the stopper 155 in the keyboard 100. The engagement parts 150, 151, 180 and 181 rotatably ascend and descend the moving mechanism 110 as a result of engagements with the moving mechanism 110.

The key 170 is molded with synthetic resin in an approximately sectionally trapezoid shape. One or more letters (not shown) are printed on the key 170 for typing purposes. The rear surface of the key 170 includes the key engagement parts 180 and 181. As discussed above, the engagement parts 180 and 181 have a connection hole or dent that are engageable rotatably with the moving mechanism 110. The elastic member 130 is located under the key 170, and a press of the key 170 deforms the elastic member 130 into a concave shape. When the press force is released, the key 170 returns to the initial state due to the elastic force of the elastic member 130. As shown in FIG. 5, a space under the key 170 has a height enough for the low-profile keyboard 100.

The elastic member 130 serves as a forcing member for forcing the moving mechanism 110 to return the key 170 to the original state. The elastic member 130 is made, for example, of rubber or spring. The elastic member 130 in the instant embodiment is made of rubber, and has a hollow dome or cylindrical shape as shown in FIG. 2. Alternatively, the elastic member 130 may be made of a spring attached to the lateral members 111*a* and 115*a* or rotary members 111*b* and 115*b*. The elastic member 130 is located between the key 170 and the base 140, and has the contact 131 in its hollow portion.

The elastic member 130 contacts the rear surface of the key 170 at its one end to force the key 170 to the initial state, and is adhered onto the membrane 141 at its other end as described later. The elastic member 130 elastically deforms as shown in FIG. 5, as the key 170 is pressed down, and returns to the initial position due to its self-elastic compensation when the pressing force is released from the key 170. The elastic member 130 returns to the original state with the key 170, and thus the key 170 may return to the original position. The contact 131 is formed at the center inside the elastic member 130 and contacts the switch part 160 on the membrane 141 when the elastic member 130 deforms. The contact between the contact 131 and the switch part 160 generates an electrical ON signal indicating that the key 170 has been pressed or indicative of information of the key 170. When the elastic member 130 returns, the contact 131 goes away from the switch part 160, generating the electrical OFF signal.

When the (ON) signal that indicates that the key 170 has been pressed down is generated by the switch part 160 as a result of the contact between the contact 131 and the switch part 160, this signal is sent to the control part or processing part (not shown) on the base 140 or another base connected to the base 140, whereby the keying and information assigned to the key 170 are recognized. While the instant embodiment moves the contact 131 in a vertical direction with the elastic member 130, the contact 131 may rotate with the key 170, i.e., in a direction different from the vertical direction, if necessary.

The base 140 supports the moving mechanism 100 rotatably, and is fixed relative to the key 170. The base 140 provides the engagement parts 180 and 181 for rotatably supporting the moving mechanism 110. The base 140 is mounted on the membrane 141, and the other end of the elastic member 130 is adhered to the base 140. The metal plate 142 is provided under the membrane 141.

The switch part 160 is made of or covered with a conductor, such as metal, and connected electrically to a substrate (not shown) located under the metal plate 142. Although the instant embodiment arranges the switch part 160 just below the contact 131, the position of the switch part 160 is not limited as long as the switch part 160 may contact the contact 131 when the key 170 is pressed. When the contact 131 contacts the switch part 160, a press of the key 170 is recognized or the key information is input. The switch part 160 may use any structure known in the art, and a detailed description thereof will be omitted.

The stopper 155 restricts a rotary angle of the moving mechanism 110 so that a rotary angle of the moving mechanism 110 may fall within a preset range. According to this keyboard 100, the stopper 155 restricts the rotary angle of the moving mechanism 100 and enables the moving mechanism 110 to move in such a direction A in FIGS. 1 and 4 that the key 170 approaches to the user. In this embodiment, the stopper 155 is integrated with the engagement part 150 while partially projecting from the engagement part 150, and contacts the longitudinal member 112. The stopper 155 is provided at least one of the base and key engagement part 150 and 180. Thus, the stopper 155 in the instant embodiment has a convex shape, contacts the moving mechanism 110 when the rotary angle of the moving mechanism 110 is a predetermined angle, and restricts its further rotation.

A description will now be given of an operation of the keyboard 100. The keyboard 100 converts a press of the key 170 into an electronic signal. When a user presses down the key 170 at the top position shown in FIG. 4, the first and second members 111 and 115 descend the key 170 as a result of rotations of the rotary parts 111*b*, 111*c*, 115*b* and 115*c* that are engaged rotatably with the engagement parts 150, 151, 180, and 181. Since the key 170 moves obliquely, this structure maintains the longer keystroke for the key 170 than the structure that moves the key 170 vertically. As a result, the laptop PC may be made low-profile while the user feels comfortable with the sufficiently long keystroke. The keyboard 100 includes the coupling member 120 for rotatably connecting the first and second members 111 and 115, and thus enables the first and second members 111 and 115 to descend synchronously. In other words, the key top descends parallel to the base 140. The inclination of the key top and the resultant detection failure of keying are prevented by preventing only one of the first and second members 111 and 115 from rotating. Thus, the keyboard 100 has good operability and sensibility as well as providing a user with comfortable key touch.

The inventive keyboard uses the coupling member 120 to connect first and second members 111 and 115 in the moving mechanism 110, thereby preventing the inclination of the key top when the key is descending and resultant detection failure of keying or information assigned to the key 170. The inventive keyboard 100 does not move the key in the vertical direction and contributes to a low-profile laptop PC.

Further, the present invention is not limited to these preferred embodiments, and various modifications and changes may be made in the present invention without departing from the spirit and scope thereof.

Thus, the inventive keyboard may have ergonomically good operability and stably detects keying.

What is claimed is:

1. A keyboard having a substantially planar base the keyboard comprising:

a plurality of keys to enter information, wherein each of said plurality of keys has a substantially planar key top and each of said plurality of keys is movable between first and second positions, a moving mechanism that moves each of said plurality of keys in a direction different from a substantially vertical direction and maintains each respective key top parallel to the base between the first and second positions, wherein said moving mechanism includes separate first and second members, rotatably provided on the base, which base is fixed relative to each of said plurality of keys, to support each of said plurality of keys, and a coupling member to connect the first and second members so that the first and second members rotate together synchronously, and a forcing member that forces each of said plurality of keys from the second position to the first position.

2. A keyboard according to claim 1, wherein said first and second members are substantially U-shaped and openings of the U-shaped first and second members face each other in the second position.

3. A keyboard according to claim 1, wherein the first and second members support each of said plurality of keys at four points.

4. A keyboard according to claim 1, further comprising a stopper that restricts a rotary angle of said moving mechanism so that the rotary angle of the moving mechanism falls within a preset range.

5. A keyboard according to claim 1, wherein said different direction is toward a user of the keyboard.

6. A keyboard according to claim 1, wherein a projection part is provided in the forcing member to transmit information on keying to a switch part that recognizes the keying.

7. A keyboard according to claim 1, wherein the forcing member is located between the first and second members.

8. A keyboard according to claim 1, wherein the forcing member is elastic.

9. A keyboard according to claim 1, wherein the coupling member connects one side of the first and second members.

10. A keyboard according to claim 1, wherein the coupling member connects opposing sides of the first and second members.

11. A keyboard according to claim 1, wherein the coupling member is rectangular.

12. An electronic apparatus comprising: a keyboard having a substantially planar base, wherein the keyboard includes a plurality of keys for entering information, wherein each of said plurality of keys has a substantially planar key top and each of said plurality of keys is movable between first and second positions, a moving mechanism that moves each of said plurality of keys in a direction different from a substantially vertical direction and maintains each respective key top parallel to the base between the first and second positions, wherein said moving mechanism includes separate first and second members, rotatably provided on the base, which base is fixed relative to each of said plurality of keys, to support each of said plurality of keys, a coupling member to connect the first and second members so that the first and second members rotate together synchronously, and a forcing member that forces each of said plurality of keys from the second position to the first position; and a display part for displaying information input from said keyboard.

* * * * *

UNITED STATES PATENT AND TRADEMARK OFFICE

CERTIFICATE OF CORRECTION

PATENT NO. : 6,880,994 B2
DATED : April 19, 2005
INVENTOR(S) : Kouki Takahashi

It is certified that error appears in the above-identified patent and that said Letters Patent is hereby corrected as shown below:

Column 8,
Line 40, delete “a keyboard hav-”;
Line 41, change “ing” to -- a keyboard having --.

Signed and Sealed this

Third Day of January, 2006

JON W. DUDAS
*Director of the United States Patent and Trademark Office*